US008328598B2

(12) United States Patent
Smith

(10) Patent No.: US 8,328,598 B2
(45) Date of Patent: Dec. 11, 2012

(54) ELASTIC REINFORCED INFRAMAMMARY CURVE BRA

(76) Inventor: Veronica C Smith, South Richmond, CA (US)

( * ) Notice: Subject to any disclaimer, the term of this patent is extended or adjusted under 35 U.S.C. 154(b) by 371 days.

(21) Appl. No.: 12/796,508

(22) Filed: Jun. 8, 2010

(65) Prior Publication Data

US 2011/0300774 A1 Dec. 8, 2011

(51) Int. Cl.
*A41C 3/00* (2006.01)

(52) U.S. Cl. ..... 450/45; 450/70

(58) Field of Classification Search ..... 450/40–449
See application file for complete search history.

(56) References Cited

U.S. PATENT DOCUMENTS

| | | | | |
|---|---|---|---|---|
| 2,140,273 | A * | 12/1938 | Simon | 450/20 |
| 2,245,095 | A * | 6/1941 | Nordseth | 139/384 R |
| 3,392,731 | A * | 7/1968 | Silverman | 450/57 |
| 3,410,742 | A * | 11/1968 | Anderberg | 156/196 |
| 3,449,765 | A * | 6/1969 | Beard et al. | 2/113 |
| 3,704,713 | A * | 12/1972 | Hopper | 450/52 |
| 3,780,741 | A * | 12/1973 | Cole | 450/92 |
| 4,091,819 | A * | 5/1978 | Huber et al. | 450/55 |
| 5,385,502 | A * | 1/1995 | Moretz et al. | 450/93 |
| 6,645,040 | B2 * | 11/2003 | Rabinowicz et al. | 450/1 |
| 7,513,817 | B2 * | 4/2009 | Cheng | 450/92 |
| 2005/0272344 | A1 * | 12/2005 | Cheng | 450/1 |

* cited by examiner

*Primary Examiner* — Gloria Hale
(74) *Attorney, Agent, or Firm* — David E. Newhouse, Esq.

(57) ABSTRACT

A contouring support bra made from soft stretchable cotton knit and light, and power-net support fabrics particularly suited for pregnant and nursing women for comfortably providing an alluring, lifted tear drop breast shape analogous to that provided by properly-fitted traditional underwire bra structures.

8 Claims, 7 Drawing Sheets

ELASTIC REINFORCED INFRAMAMMARY CURVE BRA

BACKGROUND OF THE INVENTION

1. Field of the Invention

This invention relates generally to contouring support bras providing reinforced elastic, self-adjusting support to a woman's breast conforming to the inframammary skinfold curve of her breasts, and a technique for fabricating bras to provide such support.

2. Description of the Prior Art

Support bras typically utilize underwire support structures located beneath the inframammary skinfold of the breasts at the juncture of women's breasts and her front thoracic torso to shape and support the breasts. [See patents in U.S. Class 450/39-43, 93 & 143.]

Alternatives to underwire support structures include, thin, flat, inelastic, flexible shaping or support panels of stable plastic or polyester materials incorporated, and bonded between fabric layers of the bra extending up from the torso band of the bra encircling the woman's thoracic torso below the inframammary skinfold to define or shape women's breasts. [See patents in U.S. Class 450/30-39.]

However, women's breasts have a myriad of different, unique shapes and inframammary skinfold curves that change with age, pregnancy, lactation, and surgical intervention. Women who desire or require contouring support for their breasts are perpetually searching (shopping) for support bras that are comfortable, and provide a natural alluring shape to their breasts without distorting their inframammary skinfold breast curves. This problem is compounded for pregnant and nursing women because of fluctuating breast volume. In short, existing contouring support bras with inelastic underwire and plastic support structures do not adequately or comfortably support breasts of many women, and, in particular pregnant and nursing women.

SUMMARY OF THE INVENTION

A contouring support bra made from soft stretchable cotton knit and light, and power-net support fabrics particularly suited for pregnant and nursing women comfortably provides an alluring, lifted tear drop breast shape with full coverage self-adjusting cups that accommodates breast size fluctuations with bias-cut fabrics that contour easily to expanding breast size and shape, and reinforced elastic breast casing seams that elastically conform to and provide support along the inframammary skinfold curve of each breast analogous to that provided by properly-fitted traditional underwire bra structures.

DESCRIPTION OF PREFERRED AND EXEMPLARY EMBODIMENTS

Figure 1:
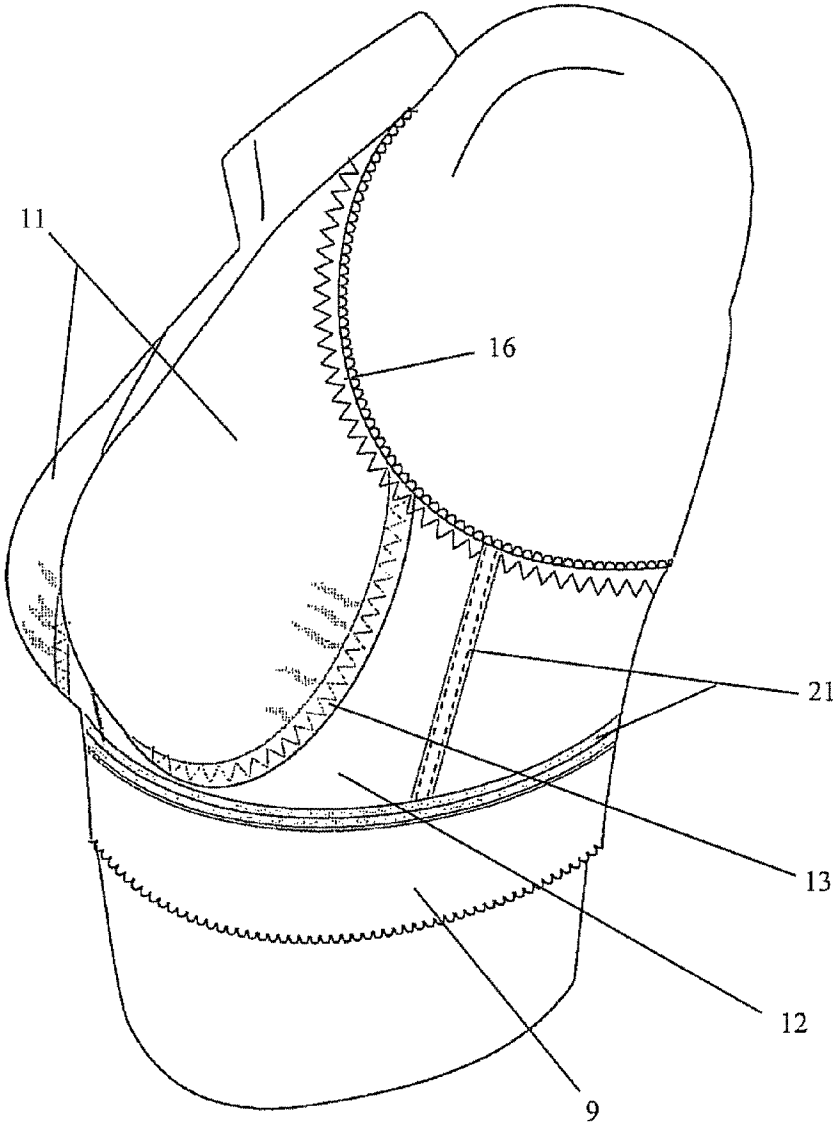
FIG. 1 is a line drawing of a side perspective view of the wireless contouring support bra on a manikin form illustrating continuation of the stretchable elastic bands sewn to, finishing the upper sides of each fabric breast cup, the topside, end of the front fabric panels and the upper edges of the back fabric panels of the bra.
Figure 2:
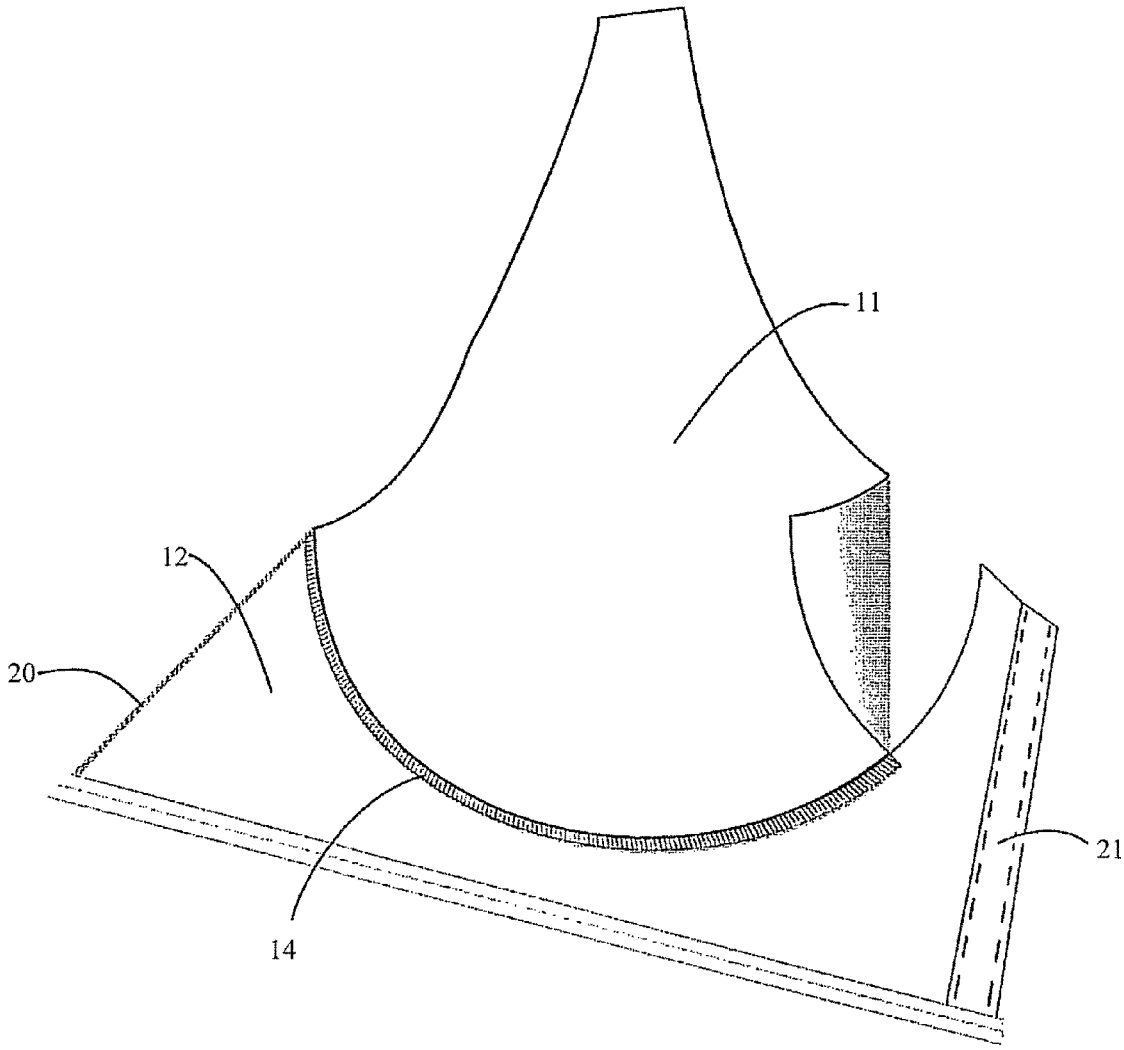
FIG. 2 is a line drawing illustrating how to the base of a fabric breast cup is attach to a stretchable front, power-net fabric panel of the bra.
Figure 3:
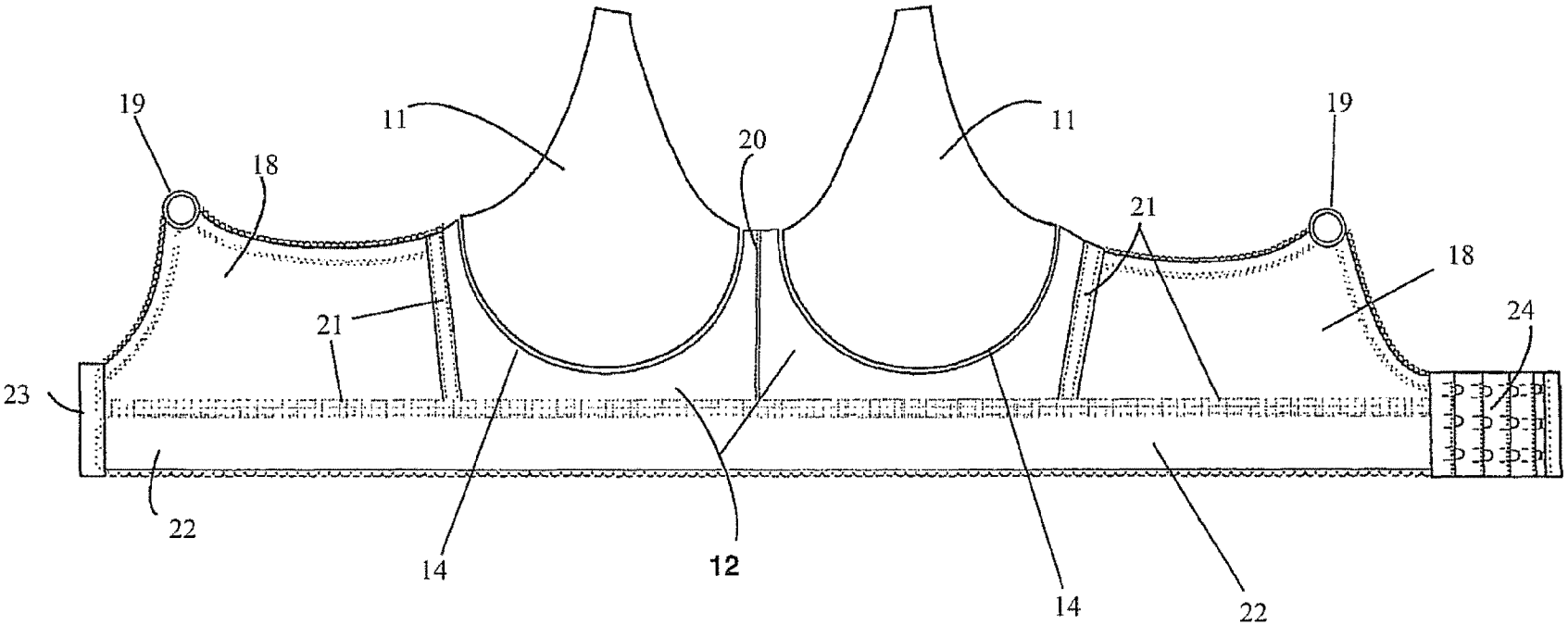
FIG. 3 is a line drawing illustrating caseing seams securing the base of the fabric breast cups to the power-net fabric front panels, the various seams joining the power-net front panels, the power-net back panels and the elastic torso band of the bra together.
Figure 4:
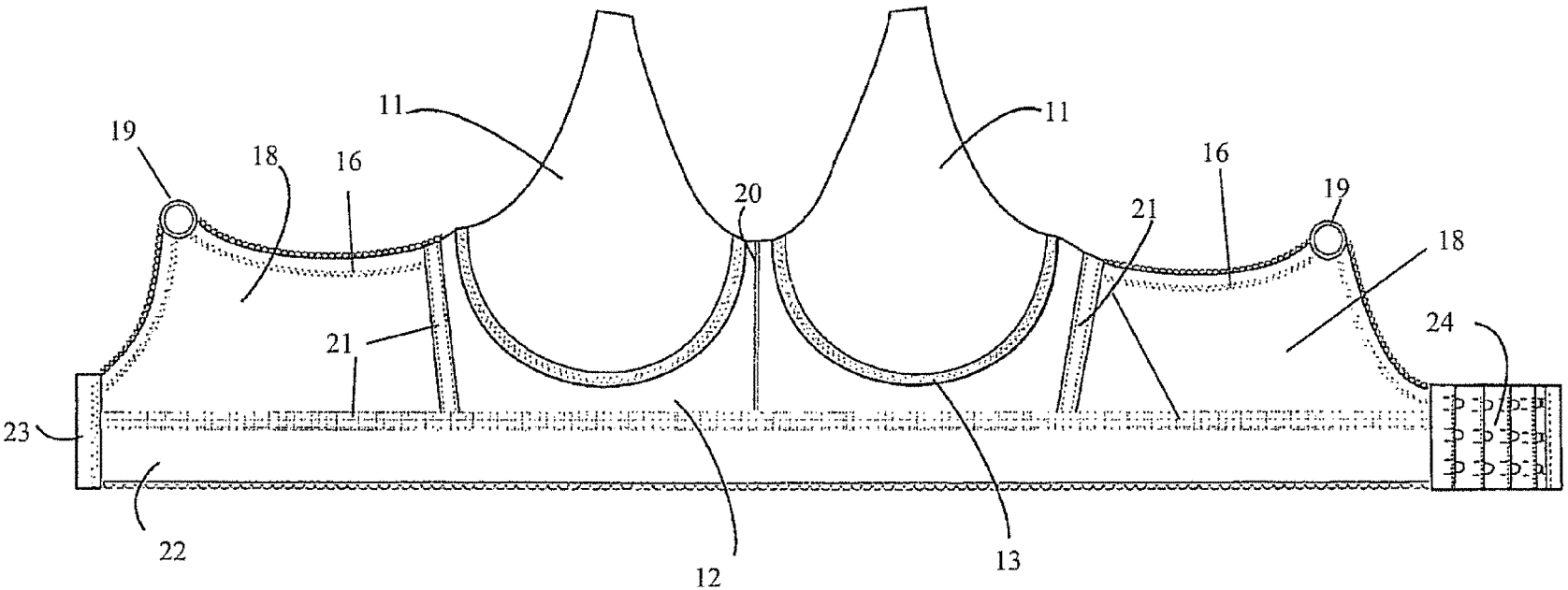
FIGS. 4 & 5 are line drawings illustrating how elastic fabric bands are folded over covering the over-locking stitch seams joining the breast cup and bra front panels then sewn using a zigzag and/or stretch stitch to form the reinforced elastic, contouring, breast casing seams of the bra.
Figure 5:
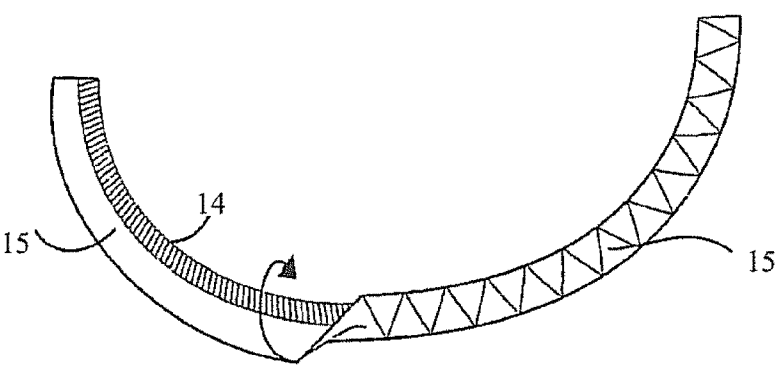
Figure 6:
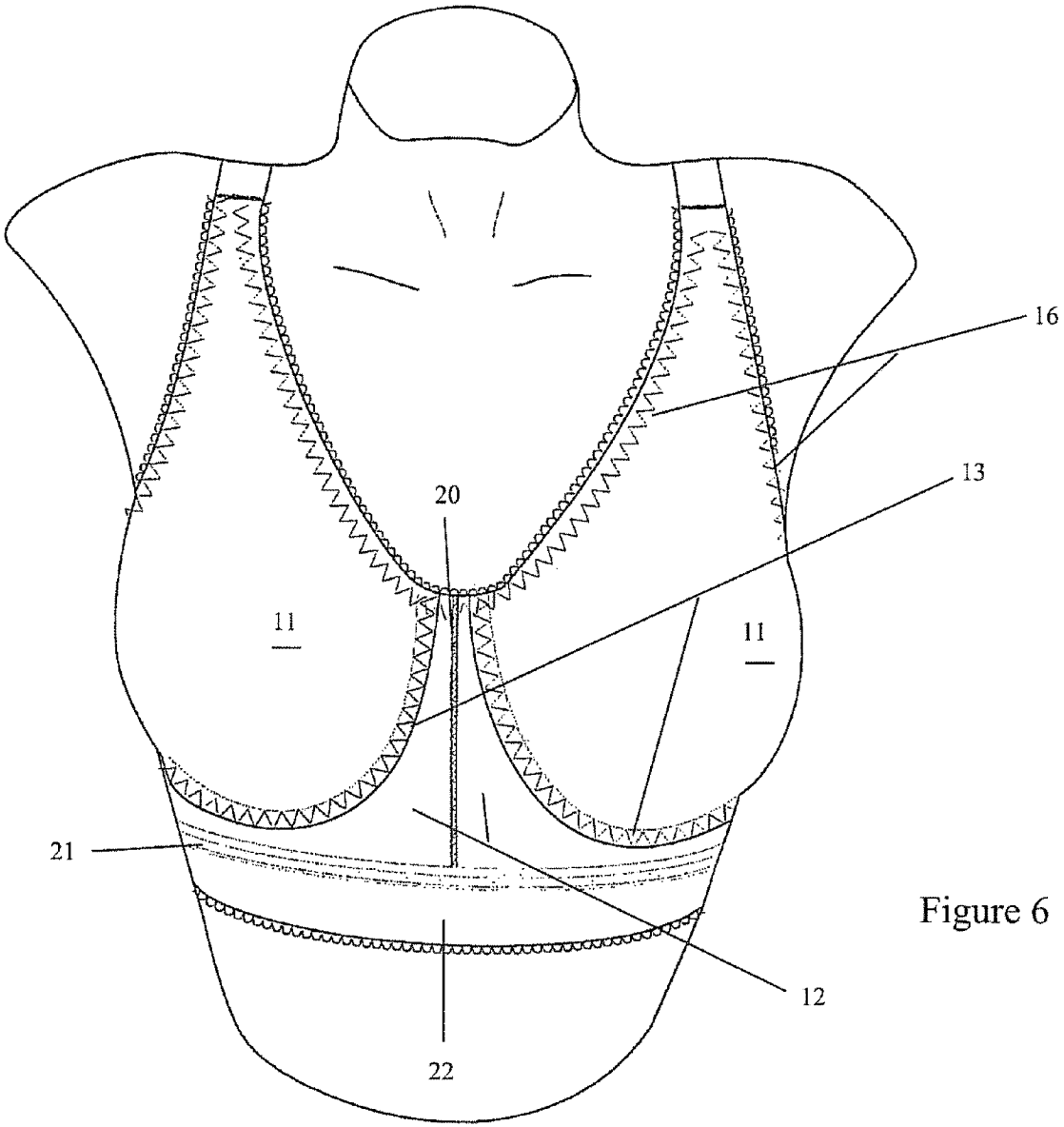
FIG. 6 is a line drawing illustrating a front view of the wireless contouring support bra on a manikin form with stretchable elastic bands sewn to, finishing the upper or top sections of each fabric breast cup attaching to shoulder straps of the bra forming an expandable surface that conforms to the upper poles of the breasts.

Looking at FIGS. 1-8, the essential elements of the invented wireless contouring support bra are an elastic, power-net fabric bra front panel(s) 12 with a straight bottom edge and symmetrical right and left semicircular top edges each stretched to match and joined with a circumferentially longer bottom semicircular edge of soft knit fabric breast cups 11 by an over-locking stitch serger seam 14 reinforced with elastic strips 15 folded-over and secured to the serger seam 14 with zigzag and/or stretch stitching (FIG. 5) for providing an exterior, contouring elastic breast casing seams 13 that elastically conform to, and provides support along the inframammary skinfold curves at the juncture of a woman's breasts and her thoracic torso. (See FIG. 1)

The exterior, contouring, elastic breast casing seams 13 of the bra are fabricated by stretching the upper semicircular top edges of the power-net elastic fabric bra front panels 12 to match the circumferentially longer bottom edge of the breast cups 11 and then joining them together with a serger over-locking stitch creating an exterior seam 14 that elastically expands and contracts. Unstretched reinforcing elastic strips 15 are then folded over and securing to the respective contracted exterior over-locking stitch seams 14 of the bra using zigzag and/or stretch stitching. The exterior breast casing seams 13 are then folded down and secured along the outside, upper circumferential side edges of the respective breast cups 11 and attached with a stretch stitch to provide support conforming to the side surfaces of the breasts curving from the upper poles of the breasts to inframammary skinfold.

Figure 7:
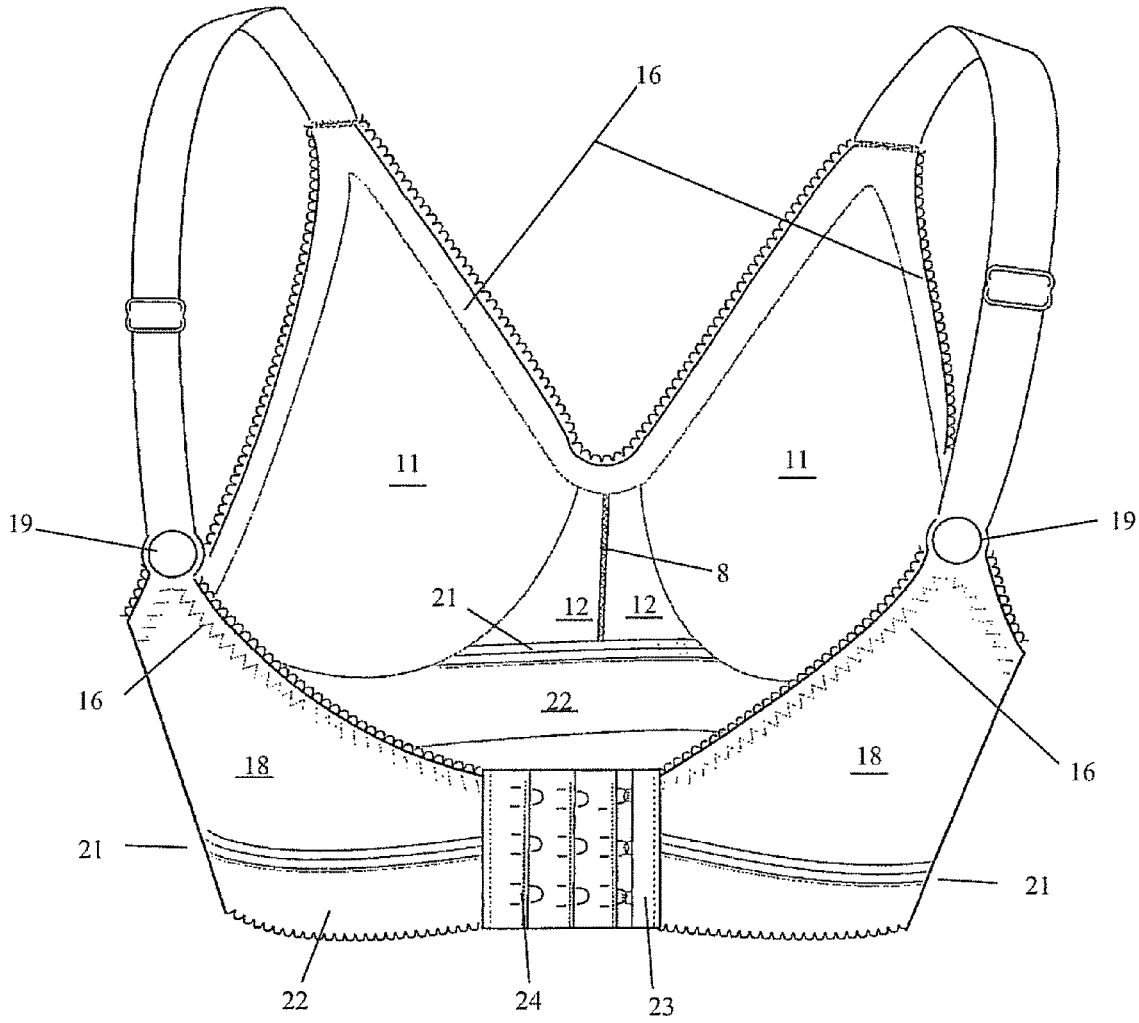
FIG. 7 is a perspective line drawing illustrating a back or rear view of the wireless contouring support bra presented as if encircling a woman, showing the stretchable elastic bands sewn to, finishing the upper edges of the back fabric panels of the bra between the shoulder support straps and the hook-and-eye fastener panels secured at the distal ends of the elastic torso band and back fabric panels of the bra.

The invented wireless contouring support bra is conventionally finished with elastic support seams 16 joining slightly stretched elastic bands 17 to the exterior surface along the remaining cut upper front and side edges of the breast cups 11, and the top and bottom edges power-net fabric front and back panels 12 & 18 of the bra with a stretch stitch, then folded over along the respective edges and sewn to the inside surfaces of the breast cups 11 and power-net fabric front and back panels 12 & 18 of the bra with zigzag and/or stretch stitching. Shoulder strap anchor tabs 19 are sewn to the top of the respective breast cups 11 (FIGS. 1 & 6) and to appropriated located top, seamed edges of the power-net fabric back panels 18 of the bra (FIG. 7). Alternatively, adjustable shoulder straps can be sewn to directly to the tops of the finished bra cups and/or to the bra back shoulder strap anchor tabs.

As illustrated in FIGS. 1-7, the front and back panels 12 & 18 of the bra are made from multiple power-net fabric panels with front panels 12 folded and joined by a central or sternum faggoting stitch 20 to provide double layer front panels secured to separate single layer power-net fabric back panels 18 with flat stretch stitched seams 21. A stabilizing elastic torso band 22 is secured by conventional flat stretch stitch seams to the bottom edges of the respective front and back bra panels. Conventional hook-and-eye adjustable fastener panels are 23 & 24 are attached at the distal ends of the torso band for securing the bra around the woman's thoracic torso.

Figure 8:
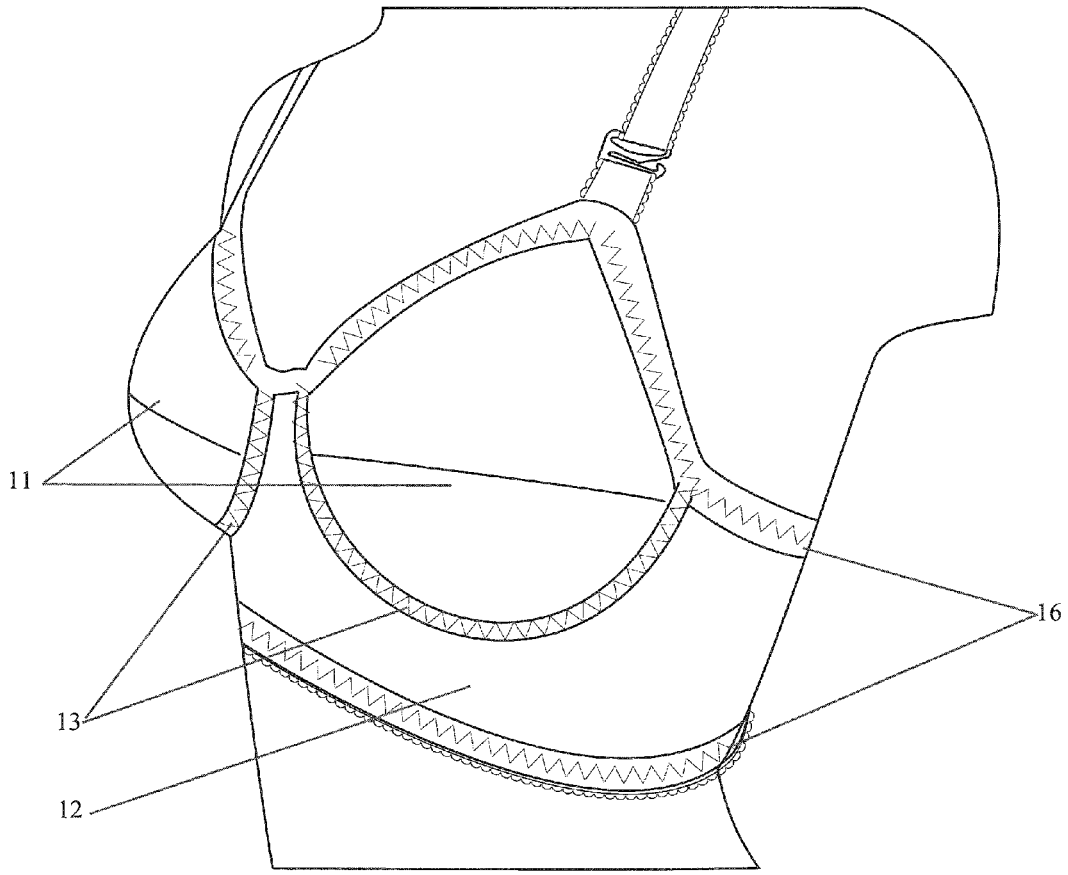
FIG. 8 presents an image of a wireless contouring support bra with a single front panel with self-adjusting, reinforced elastic casing seams that conform the breast cup to the inframammary curve of a manikin form.

As shown in FIG. 8, the front and back panels 12 & 18 of the invented wireless contouring support bra may also be formed from a single piece of one or two layers of power-net fabric finished with reinforced top, end, and a bottom elastic support seams 16 instead of a torso band as described above with conventional adjustable fasteners for securing the bra around a woman's thoracic torso across the back.

The invented wireless contouring support bra may also be constructed with conventional front or sternum hook-and-eye closure panels for allowing easy nursing access.

I claim:

1. A method for joining soft knit fabric breast cups of a bra and an elastic power-net bra front panel for providing wireless, elastic support along, conforming to the inframammary skinfold curve of each breast of a woman, the steps comprising, a) providing a pair of soft knit fabric breast cups with each breast cup having a semicircular, cut, bottom edge with a particular circumferential length for accommodating a woman's breasts, b) providing an elastic power net fabric bra front panel having two semicircular cut-out breast cup attachment locations with each attachment location having an upper cut edge length that is shorter than that of each breast cup semicircular, cut, bottom edge circumferential length, c) stretching and aligning and the upper edge of the attachment location of each semicircular, breast cup, cut-out of the front panel to match the circumferential length of the semicircular, cut, bottom edge of one of the soft knit fabric breast cups, d) joining the aligned bottom semicircular edge of each breast cup with each stretched and aligned semicircular upper cut edge of the respective attachment locations of the elastic power-net bra front panel with an over-locking stitch, outside seam, e) folding a reinforcing, elastic fabric strip over the outside seam, f) securing the reinforcing, elastic fabric strip folded over the outside seam with a stretchable zigzag stitch structure, whereby, the outside seam with the secured reinforcing elastic strip projects outward and extends conforming to the inframammary skinfold curve for supporting and shaping each of the woman's breasts in combination with the breast cups.

2. A contouring support bra for providing elastic support along, and conforming to inframammary skinfold curves of each of a woman's breasts comprising in combination:

a) a pair of power-net elastic fabric panels joined together by a central flat faggot seam with each panel being folded back from the central flat faggot seam to provide symmetrical left and right, elastic, double-layer, front support panels each having a relaxed, semicircular top edge between a top central sternum seam edge and a slanting, straight top edge, a slanting side edge and a straight bottom edge;

b) a pair of soft stretchable fabric breast cups each having a front concave side edge and a side concave side edge tapering to a top strap anchor tab, and a semicircular bottom edge having a circumferential length greater than that of each one of the relaxed semicircular top edges of the elastic, double-layer front support panels;

c) exterior, over-locking stitch seams joining, respectively, the top semicircular edges of the left and the right elastic, double-layer front support panels to the lower semicircular edge of a fabric breast cup, the relaxed semicircular top edge of each front support panel being stretched to conform to the circumferential length of the lower semicircular edge of the breast cup;

d) reinforcing, elastic strips folded over the outside, over-locking stitch seams joining the breast cups and the double layer front support panels, secured by zigzag and stretch stitching for providing elastic support along, and conforming to the inframammary skinfold curve of each breast of a woman;

e) a pair of elastic power-net elastic fabric back support panels with straight bottom edges, each having a slanted side edge secured to a slanted a side edge of a double-layer, front support panel, each also having a concave top edge, and a concave back side edge tapering to a back shoulder strap anchor edge and;

f) reinforcing, elastic strips stretched, and secured by zigzag stitching to:

(i) the front concave side edges and the top central sternum seam edges of each fabric breast cup crossing the central sternum seam joining the double layer front support panels; and (ii) the respective left and right side concave edges of the breast cups, the respective left and right slanting top edges of the front support panels, the respective left and right concave top and side edges of each back support panel, wherein, the reinforcing, elastic strips overlap approaching, and at the top anchor edge of the respective left and right breast cups to provide a pair of front shoulder strap anchors, and also overlap approaching, and at the back shoulder strap anchor edge of the respective left and right back support panels to provide a pair of back shoulder strap anchors;

g) an elastic torso band having:

(i) distal ends with adjustable means for securing the distal ends together, (ii) a length sized for stretching around a woman's thoracic torso below her inframammary skinfold, and (iii) an upper edge, where the straight bottom edges of the double layer, front support panels, and the back support panels are secured to the upper edge of the torso band; and h) a pair of adjustable shoulder support straps each having distal ends with means for fastening between a front shoulder strap anchor and a back shoulder strap anchor.

3. A method for fabricating finishing contouring support bra for providing elastic support along, and conforming to inframammary skinfold curves of each of a woman's breasts comprising:

a) cutting out an identical pair of power-net elastic fabric panels each having a symmetrical left and right a relaxed, semicircular top edge, a slanting, straight central top sternum edge, a slanting top side edge, a slanting side edge and a straight bottom edge;

b) joining an identical pair of power-net elastic fabric panels together with a central sternum seam;

c) folding each panel back on itself from the central sternum seam to provide symmetrical, left and right, double-layer, front support panels;

d) cutting out a pair of soft stretchable fabric breast cups each having a front concave side edge and a side concave side edge tapering to a top front shoulder strap anchor edge, and a lower semicircular bottom edge having a circumferential length greater than that of the relaxed top edges of the elastic, double-layer front support panels;

e) stretching and joining respectively, the top semicircular edges of the left and the right elastic, double-layer front support panels to a lower semicircular edge of a fabric breast cup with exterior over-locking stitch seams;

f) folding a reinforcing elastic strip over the exterior over-locking stitch seams joining the breast cups and the double layer front support panels;

g) securing the folded-over, reinforcing elastic strips to the exterior over-locking stitch seams with stretch stitching for providing elastic support along, and conforming to the inframammary skinfold curve of each breast of a woman;

h) cutting out respective left and right power-net elastic fabric back support panels with straight bottom edges, each having each having a slanting side edge, a concave top edge, and a concave back side edge tapering to a back shoulder strap anchor edge;

i) joining the respective left and right slanting side edges of the back support panels to the left and right slanted side edges of the double layer front support panels with a flat-locking seam;

j) providing an elastic torso band having:

(i) distal ends with adjustable means for securing the distal ends together, (ii) a length sized for stretching around a woman's thoracic torso below her inframammary skinfold, and (iii) an upper edge, k) joining the straight bottom edges of the respective left and right joined front and back support panels to the upper edge of the elastic torso band using with zigzag and stretch stitching;

l) joining a top edge of finishing reinforcing, stretched elastic strips using stretch stitching to:

(i) exterior surfaces of the fabric breast cups joined with the front support panels along the front concave side edges of the breast cups and along the top sternum edges of the front support panels crossing the central sternum seam; and (ii) the exterior surfaces of the breast cups, along the respective left and right side concave edges, the exterior surfaces of the respective left and right slanting top edges of the front support panels, and along the exterior surfaces of the respective left and right concave top and side edges of each back support panel;

m) folding the finishing reinforcing, stretched elastic strips over to respective left and right insides surfaces of the breast cups, front support panels, and back support panels;

n) securing the folded-over, finishing, reinforcing, stretched elastic strips to the inside surfaces of the breast cups, front support panels, and back support panels with zigzag stitching, wherein the secured, finishing reinforcing, stretched elastic strips overlap approaching, and at the respective top front shoulder strap anchor edges of the left and right the breast cups to respectively form a left and a right front shoulder strap anchor structure, and overlap, approaching and at the respective left and right anchor edges of the back support panels to respectively form a left and a right back shoulder strap anchor structure;

o) securing adjustable shoulder support straps between the right front and back shoulder strap anchor structures, and between the left front and back shoulder anchor structures.

4. A seam structure joining a pair of soft knit fabric breast cups to an elastic power net bra front panel having two breast cup attachment locations wherein the formed seam structure provides a wireless, elastic support along each cup and front panel attachment location for placement along and conforming to each inframammary skinfold curve of each breast of a woman wearer when the bra is worn, comprising, in combination:

a) a pair of soft knit fabric breast cups of a bra with each breast cup having a semicircular, cut, bottom edge with a particular circumferential length for accommodating a woman's breast;

b) an elastic power-net fabric bra front panel having two semi- circular cut out breast cup attachment locations with each attachment location having an upper edge length that is shorter than each semicircular circumferential lengths of the cut, bottom edge of each breast cup;

c) an exterior, over-locking stitch seam joining the bottom semicircular edge of each breast cup with a semicircular upper cut edge of a semicircular cut out breast cup attachment location of the elastic power-net bra front panel that is stretched to match the circumferential length of the bottom semicircular edge of the breast cup;

d) a reinforcing, elastic fabric strip folded over the exterior over locking stitch seam on each breast cup and front panel attachment location and secured thereto by zigzag, stretchable stitching;

whereby, the seam structure projects outwardly and elastically extends along and conforms to the wearer's inframammary skinfold curve to thereby form a structure that supports and shapes each of the woman's breasts in combination with the breast cups.

5. The contouring support bra of claim 2 wherein the stretch stitching securing the reinforcing, elastic strips folded over the outside, over-locking stitch seams joining the breast cups and the double layer front support panels is a stretchable zigzag stitching structure.

6. The contouring support bra of claim 2 wherein the stretch stitching securing the reinforcing, elastic strips folded over the outside, over-locking stitch seams joining the breast cups and the double layer front support panels is an elastic thread stitching structure.

7. The method for fabricating finishing contouring support bra of claim 3 wherein the reinforcing, elastic strips folded over the outside, over-locking stitch seams joining the breast cups and the double layer front support panels are secured by a stretchable zigzag stitching structure.

8. The method for fabricating finishing contouring support bra of claim 3 wherein the reinforcing, elastic strips folded over the outside, over-locking stitch seams joining the breast cups and the double layer front support panels are secured by an elastic thread stitching structure.

* * * * *